US006587763B2

(12) United States Patent
Ishikawa

(10) Patent No.: US 6,587,763 B2
(45) Date of Patent: Jul. 1, 2003

(54) TRAIN CONTROL SYSTEM AND METHOD THEREFOR

(75) Inventor: Takuya Ishikawa, Tokyo (JP)

(73) Assignee: East Japan Railway Company, Tokyo (JP)

( * ) Notice: Subject to any disclaimer, the term of this patent is extended or adjusted under 35 U.S.C. 154(b) by 0 days.

(21) Appl. No.: 10/005,477

(22) Filed: Nov. 12, 2001

(65) Prior Publication Data

US 2003/0093195 A1 May 15, 2003

(51) Int. Cl.[7] ..... B61L 25/02

(52) U.S. Cl. ..... 701/19; 340/991; 340/992; 340/993; 455/500; 246/3

(58) Field of Search ..... 701/19, 117, 200, 701/207, 213, 20; 340/993, 992, 991; 455/440, 436, 439, 456, 500, 457; 303/106; 342/357.06; 246/3, 4, 5, 7, 19, 62, 122 R, 177, 182 R, 182 C, 187 A, 63 C

(56) References Cited

U.S. PATENT DOCUMENTS

| | | | | |
|---|---|---|---|---|
| 4,235,402 | A | * 11/1980 | Matty et al. | 246/5 |
| 5,487,516 | A | * 1/1996 | Murata et al. | 246/182 C |
| 5,533,695 | A | * 7/1996 | Heggestad et al. | 246/62 |
| 5,950,966 | A | * 9/1999 | Hungate et al. | 246/62 |
| 6,234,428 | B1 | * 5/2001 | Bachtiger et al. | 246/7 |
| 6,317,664 | B2 | * 11/2001 | Oguma et al. | 701/19 |
| 6,321,090 | B1 | * 11/2001 | Soliman | 455/440 |
| 6,402,094 | B1 | * 6/2002 | Beer | 246/122 R |
| 6,405,127 | B1 | * 6/2002 | Doner | 701/207 |
| 2001/0022332 | A1 | * 9/2001 | Harland | 246/122 R |

FOREIGN PATENT DOCUMENTS

JP 407186960 A * 7/1995

OTHER PUBLICATIONS

Nishinaga, E.; Evans, J.A.; Mayhew, G.L., "Wireless Advanced Automatic Train Control", Railroad Conference, 1995.; Proceedings of the 1994 ASME/IEEE Joint (in Conjunction with Area 1994 Annual Technical Conference), Mar. 22–24, 1994, pp 31–46.

AATC, Advanced Automatic Train Control, Internet: http://216.247.86.33/Products/ATCS/aatc.html.

Albanese, Damian F., et al., Pseudorandom Code Waveform Design for CW Radar, IEEE Transactions on Aerospace and Electronic Systems, vol. AES–15, No. 1, Jan. 1979.

R. John Hill and Louisa J. Bond, Modelling Moving–Block Railway Signalling systems Using Discrete–Event Simulation, Proceedings of the 1995 IEEE/ASME Joint Railroad Conference, Apr. 4–6, 1995, pp. 105–111.

* cited by examiner

*Primary Examiner*—Thomas G. Black
*Assistant Examiner*—Tuan C To
(74) *Attorney, Agent, or Firm*—Darby & Darby

(57) ABSTRACT

A system and method to flexibly control intervals between trains in which there are base stations at predetermined intervals along a train rail. Each base station has a radar which detects data of distance between the base station and trains moving on the train rail, a traveling command calculator which calculates a traveling command based on the date of distance, and a traveling command providing device which provides the traveling command calculated by the traveling command calculator to the trains.

21 Claims, 6 Drawing Sheets

112:Bi-DIRECTIONAL DISH ANTENNA
113:CONTROL CIRCUIT
114a:TRAIN INTERVOL CALCULATOR
114b:SPEED COMMAND CALCULATOR
114c:TRAIN NUMBER CONFIIRMER
115a:SPEED COMMAND TRANSMITTRE
115b:TRAIN NUMBER RECEIVER
116:SIGNAL TRANSMITTER

122:Bi-DIRECTIONAL DISH ANTENNA
123:CONTROL CIRCUIT
124a:TRAIN INTERVOL CALCULATOR
124b:SPEED COMMAND CALCULATOR
124c:TRAIN NUMBER CONFIIRMER
125a:SPEED COMMAND TRANSMITTRE
125b:TRAIN NUMBER RECEIVER
126:SIGNAL TRANSMITTER

212a:SPEED COMMAND RECEIVER
212b:TRAIN NUMBER TRANSCEVER

FIG. 4

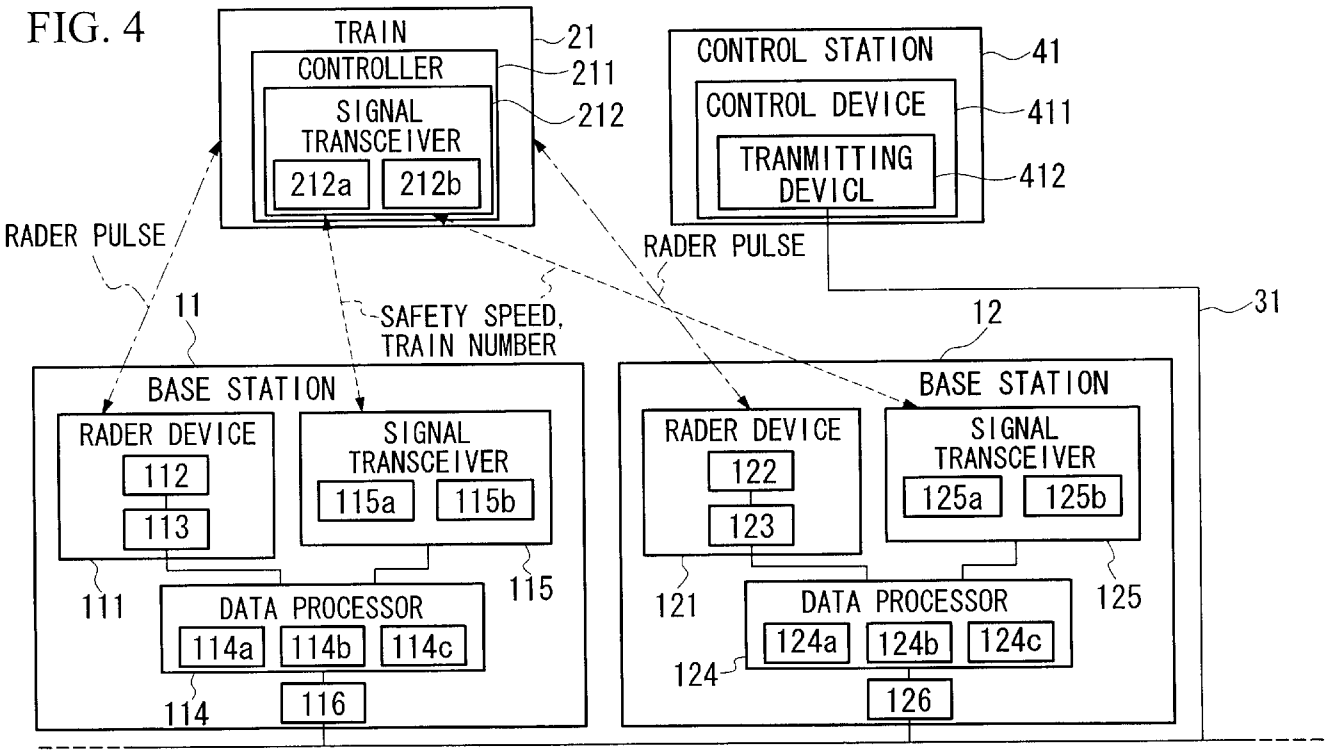

112;Bi-DIRECTIONAL DISH ANTENNA
113;CONTROL CIRCUIT
114a;TRAIN INTERVOL CALCULATOR
114b;SPEED COMMAND CALCULATOR
114c;TRAIN NUMBER CONFIIRMER
115a;SPEED COMMAND TRANSMITTRE
115b;TRAIN NUMBER RECEIVER
116;SIGNAL TRANSMITTER

122;Bi-DIRECTIONAL DISH ANTENNA
123;CONTROL CIRCUIT
124a;TRAIN INTERVOL CALCULATOR
124b;SPEED COMMAND CALCULATOR
124c;TRAIN NUMBER CONFIIRMER
125a;SPEED COMMAND TRANSMITTRE
125b;TRAIN NUMBER RECEIVER
126;SIGNAL TRANSMITTER

212a;SPEED COMMAND RECEIVER
212b;TRAIN NUMBER TRANSCEVER

FIG. 12

| TRAIN NUMBER | #1 | #2 | #3 | #4 | #5 |
|---|---|---|---|---|---|
| BASE STATION (TRAMSMITTING SPEED COMMAND) | BASE STATION C | BASE STATION C | BASE STATION C | BASE STATION B | BASE STATION B |
| DISTANCE FOR CALCULATING INTERVAL | $R_{C1}$ | $R_{B1}, R_{C2}$ | $R_{B2}, R_{C3}$ | $R_{B3}, R_{C4}$ | $R_{A4}, R_{B5}$ |
| HAND OFF FOR CALCULATING INTERVAL | —— | B TO C $R_{B1}$ | B TO C $R_{B2}$ | —— | A TO B $R_{A4}$ |
| BASE STATION DETECTING SPEED | BASE STATION C | BASE STATION C | BASE STATION C | BASE STATION B | BASE STATION B |

TRAIN CONTROL SYSTEM AND METHOD THEREFOR

BACKGROUND OF THE INVENTION

1. Field of the Invention

The present invention relates to a train control system which tracks trains and controls the speeds of the trains.

2. Background Art

In a conventional train transportation control system for determining a position of a train and for controlling intervals between trains, a signal system of a fixed-block system using track circuits is in used. This fixed-block system consists of a plurality of blocks made by pairs of train rails mutually insulated at predetermined interval along a train track, and the rails of the each pair are mutually insulated between the rails of the train track. One rail of the pair is electrically connected to another rail by a train which passes on the pair of rails; therefore, one can determine the point at which a train is passing by determining where a pair of rails are mutually conducting. The track circuits thus constructed are combined with the signal system in which signals are controlled so as to permit one train to enter one block. In other words, only one train is permitted to enter one fixed-block; therefore, accuracy of controlling of the train interval is limited by length of the block. We call a block where one train is permitted to enter a "fixed-block" and call a length of the block the "fixed-length".

Because the length of the block is fixed in the above conventional fixed-block system, it is difficult to vary intervals between trains. The number of "fixed-blocks" may be increased by shortening the "fixed-length", but the cost of facilities also increase. Because the fixed-block system consists of many cables and connecting points, the cables require complicated management. Furthermore the fixed-block system thus constructed of many cables and relays increases the cost for maintaining the system.

SUMMARY OF THE INVENTION

The present invention was made in the view of the above-mentioned problems and seeks to flexibly control intervals between trains, and also seeks to establish a train control system and method therefor with fewer cables and without relays. Furthermore, the present invention seeks to reduce costs for facilities for a train control system and costs for maintaining the train control system therefor.

As a solution to the above problems, the invention provides a train control system for controlling trains, which consist of one or plurality of vehicles, comprising base stations at predetermined intervals along a train rail, wherein each base station consists of a radar which measures one or more of data of distance between the base station and one or more trains moving on the train rail; a traveling command calculator which calculates a traveling command based on the data of distance detected by said radar and another radar; a traveling command providing means which provides the traveling command calculated by the traveling command calculator to the trains.

The present invention also discloses a method for controlling trains, which consists of one or more vehicles, by base stations at predetermined intervals along a train rail comprising steps of detecting data of distances between each base station and one or more trains moving on the train rail by a radar arranged in each base station; calculating a traveling command based on the one or more of data of the distance between one or more trains and each base station which is determined by the radar arranged in each base station.

According to the above system and method for train control, it is possible to dynamically adjust a "fixed-block" and also to vary a train interval by using radio transmission techniques with a plurality of radars. Because the above train control system and method do not require as many cables as the conventional train control system and require no relays, it is possible to reduce costs for facilities for a train control system and costs for maintaining the train control system thereof.

BRIEF DESCRIPTION OF THE DRAWINGS

FIG. 4 is a block diagram for explaining a composition of each element of the preferred embodiment in FIG. 1.

FIG. 12 is a table of functions and data required for determining a plurality of trains of FIG. 11.

DETAILED DESCRIPTION OF THE INVENTION

Hereinafter, preferred embodiments of the present invention are described with reference to the figures.

Figure 2:
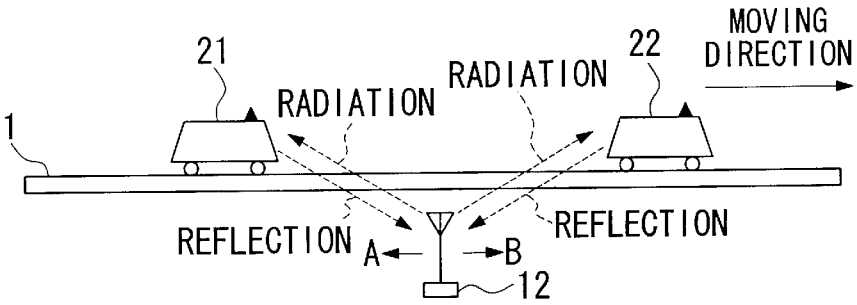
FIG. 2 is an illustration for explaining an operation of the preferred embodiment in FIG. 1.
Figure 3:
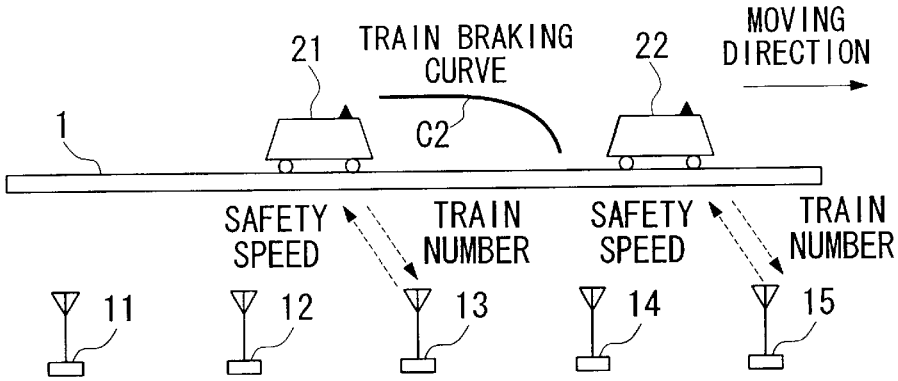
FIG. 3 is an illustration for explaining an operation of the preferred embodiment in FIG. 1.

First, a general construction of the preferred embodiment is described with reference to the FIGS. 1 to 3.

The train control system of the present application adopts a train control system in which a length of a fixed-block is flexible, instead of a conventional train control system in which the length of a fixed-block is fixed. As shown in FIG. 1, the train control system of the present application adopts radar systems which are arranged at base stations 11, 12, 13, 14, 15, . . . , and determines positions and the speeds of trains 21, 22, 23, . . . . The train control system calculates intervals between the trains based on the positions and the speeds thus determined, calculates and generates the Train Braking Curve (in other words, a Safety Speed Curve) C1, C2, . . . for each train, and outputs the Safety Speed Curve thus generated to the corresponding train in order to control the speed of the train. The above train control system thus constructed calculates the distances between the trains by the position and speed of the each train detected by the radars which trace each train and control distances between the trains within a predetermined safety range by controlling the speed of each train. Therefore, it is possible to dynamically set up a "fixed-block" into which one train is permitted to enter based on the position of each train.

Figure 1:
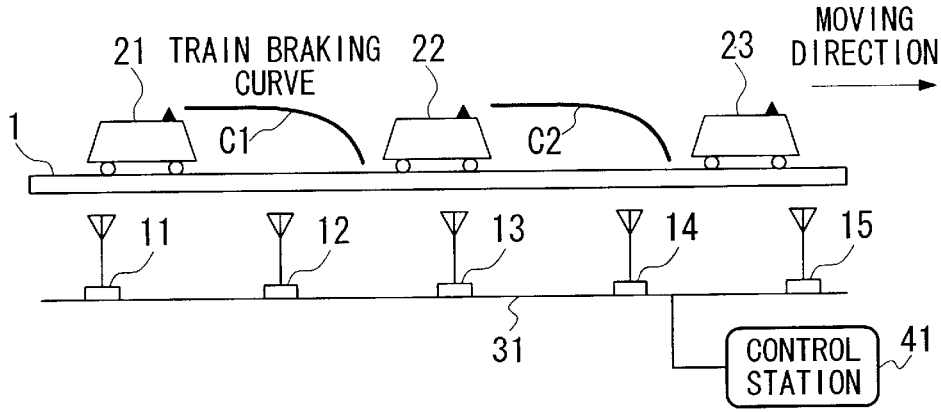
FIG. 1 is an illustration of a train control system of a preferred embodiment of the present application.

FIG. 1 illustrates the train control system of the present invention for a single-track model. In FIG. 1, the direction through which each of the trains is moving is from the left side to the right side, and this moving direction is indicated by the arrow. In the embodiment of FIG. 1, the base stations 11, 12, 13, 15, . . . are mutually connected and are also connected to a central control station 41 which determines and controls the base stations 11, 12, 13, 14, 15, . . . by wired or wireless network 31. FIG. 1 also illustrates the Train Braking Curves C1, C2, . . . which correspond with commands which vary with the passage of time to control the speeds of the trains.

In the present invention "train tracing" means an identification of a position and a speed of a train. The position and the speed of the train are determined by a propagation time of a radar beam and signs of Doppler shifting. Therefore, a transmitter and a receiver for the radar beam are arranged in each base station. The antenna of the radar of the each base station has directivity for two directions which are opposite to each other and are indicated by A and B in FIG. 2. The antenna detects both trains, one of which (train 21 in FIG. 2) is approaching the base station 12, and the other one of which (train 22 in FIG. 2) is receding from the base station 12. For instance, a pair of antennas, one of which has directivity opposite to the other is available for the radar. An antenna having a single-directivity mounted on a turntable for changing a detecting direction is also available for the radar.

In this application, "the radar" means a device which emits pulsed electromagnetic waves at a target and detects the moving direction and speed of the target by electromagnetic waves reflected from the target. The radar also detects magnitude and direction of the speed of the target by detecting Doppler shifting and variation with the passage of time of the reflected beam.

In this application, "the train control" means to calculate a Safety Speed from the locations and the speeds of trains thus detected and also to transmit the Safety Speed to the trains in order to prevent a collision. For instance the predetermined base stations 13 and 15 in FIG. 3 transmit the calculated Safety Speed to the trains 21 and 22 by the radio traffic. The trains 21 and 22 control the speed thereof by the Safety Speed thus calculated. The trains 21 and 22 transmit characteristic train numbers for identifying the trains to the base station in order to confirm the received Safety Speed.

The train control system thus constructed has the following advantages.

It is possible to reduce facilities for maintenance and also to reduce the cost for maintenance. Because the train control system does not require any relay, it is possible to simplify facilities for train control. It is also possible to flexibly change an interval between trains according to conditions of traffic in a block.

An example for a construction of each element illustrated in FIG. 1 will be explained with reference with FIG. 4. In FIG. 4, the members which are identical to those members in FIG. 1 are designated by the same reference numerals in the FIG. 1. As illustrated in FIG. 4, the train 21 consists of one or a plurality of vehicles wherein a controller 211 to control a unit to drive the train 21 etc., is mounted. This controller 211 consists of a signal transceiver 212 to send and receive,data with each base station. The signal transceiver 212 consists of a speed command receiver 212*a* and a train number transceiver 212*b* which sends train number data sent by a base station to another base station.

The base station 11 consists of a radar device 111 which consists of a bi-directional circular dish antenna 112 and a control circuit 113 thereof a data processor 114; a signal transceiver 115 which consists of a speed command receiver 115*a* and a train number receiver 115*b* to communicate data with each of the trains; and a signal transmitter 116 which communicates data with the other base stations or the central control station 41.

The data processor 114 consists of a train interval calculator 114*a*, a speed command calculator 114*b* and a train number confirmer 114*c*. The data processor 114 performs a calculation to obtain a train interval, a calculation to obtain a train speed and a calculation to confirm a train number. The data processor also performs a transmission of the data of the position and the speed of the each train detected by the radar device 111 from the one base station, for instance the base station 11, to another base station, for instance the base station 12, and receives the data of the position and the speed of the train or other trains. Furthermore, the data processor 114 transmits the data of the tracing train and the condition of each processing to the central station 41.

The train interval calculator 114*a* calculates intervals between one or more trains which exist in a block to be detected and the other trains which exist adjacent in front and rear to the one or more trains by the following data.

1. The position data of the one or more trains detected by the radar device 111 of one of the base stations.
2. The position data of the one or more trains or the other trains detected by another base station.
3. A distance between the one base station and another base station.

It is possible for one base station to neglect the above calculation in the case where the other base station calculates the same interval as the interval calculated by the one base station.

The speed command calculator 114*b* calculates a speed command to define a Train Braking Curve illustrated in FIG. 1 for one or more trains to which the Train Braking Curve must be sent based on the distance data calculated by the train interval calculator 114*a*, the speed data, of one or more trains, which one base station 11 received from the radar device 111, the position data of the one or more trains or the other trains detected by the other base station and the distance data between the one base station and the other base station.

A train to which the speed command must be sent from one base station is, for instance, a train to which the one base station is located in front of the train. For instance, as illustrated in FIG. 1 the base station 12 sends a speed command to the train 21, the base station 14 sends another speed command to the train 22 and the base station 15 sends another speed command to the train 23. The speed command thus calculated by the speed command calculator 114*b* is sent to the each corresponding train by the speed command transmitter 115*a*.

The train number confirmer 114*c* transmits the speed command to a corresponding train by the speed command transmitter 115*a* and confirms train number data received from the corresponding train by the train number receiver 115*b* by judging whether an interval between the transmission timing of the speed command and the reception timing of the train number is in a predetermined length. The train number confirmer 114*c* transmits the speed command again to the corresponding train through the speed command transmitter 115*a* and also transmits a result of the confirmation "good" or "no good" according to the judgment.

The base station 12 has the same construction as the base station 11. In other words, the base station 12 consists of the same radar device 121 as the radar device 111, the same data processor 124 as the data processor 114, the same signal transceiver 125 as the signal transceiver 115 and the same signal transmitter 126 as the signal transmitter 116. The bi-directional dish antenna 122 is the same as the dish antenna 112. The control circuit 123 is the same as the control circuit 113. The train interval calculator 124*a* is the same as the train interval calculator 114*a*. The speed command calculator 124*b* is the same as the speed command calculator 114*b*. The train number confirmer 124*c* is the same as the train number confirmer 114*c*. The speed command transmitter 125*a* is the same as the speed command transmitter 115*a*. The train number receiver 125*b* is the same as the train number receiver 115*b*.

The central station 41 consists of a control device 411 which integrates and monitors data for the train control. The control device 411 consists of a signal transmitting device 412 which performs communication with the base stations 11, 12, . . . by a network 31 and is capable of monitoring conditions of a train tracing and conditions of an operation in the base station.

Next, a method for tracing trains operated by the train control system in FIG. 1 will be explained with reference to FIGS. 5 to 12. In FIGS. 5 to 12, the members which are identical to the members in FIGS. 1 to 4 are designated by the same reference numerals as in FIGS. 1 to 4.

The following train control system is explained on the assumption that trains move on a straight single track in one direction. The trains which move forward in the same direction can be determined in each of the directivities of the bi-directional antenna. In other words, signs of train the speeds detected in each directivity of the bi-directional antenna will be fixed in one of the signs "plus(+)" which indicates approaching and the "minus(−)" which indicates receding. In another case where trains move in two directions on each of a straight double track, the plus and the minus speeds can be determined in each of the directivities of the bi-directional antenna. Therefore, it is possible to trace trains which move in two directions on each of a double track by adding signs for the speeds of trains according to directivities of the bi-directional antenna.

The following train control system is also explained on the assumption that trains move on a straight track instead on an actual curved track in order to simplify the explanation. The present invention is also possible for an actual curved track by adjusting distances between base stations to be shorter or by employing an antenna having further directivities.

Figure 5:
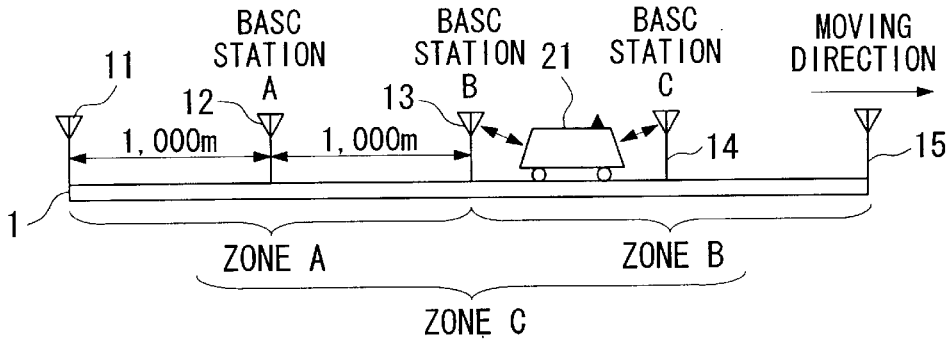
FIG. 5 is a illustration for explaining a function of the preferred embodiment in FIG. 1.

We also assume that the base stations 11, 12, 13, 14, 15 with bi-directional antennas are installed at intervals of 1,000 immediately to the side of the rail track 1, and that the base stations 11, 12, 13, 14, 15 can detect trains in a zone within 1,000 meters in either direction (see FIG. 5). The base station A only performs monitoring of the zone A. The base station B only monitors the zone B. The base station C only monitors the zone C. The base stations A(12), B(13) and C(14) do not use train information from further than 1,000 meters from each station.

A train 21 between two base stations B(13) and C(14) is detected by each of the stations B(13) and C(14) so that the system takes an accurate measurement of the train's position and speed by comparing the data from the one station with the data from the other station at the central base station 41 or by using an average of the data detected by the stations.

Next, construction and functioning of the each radar device will be explained. Basically, the train control system of the present invention employs Code-Division Multiple Access (CDMA) with a direct-sequence spread-spectrum. In this system, each base station uses a pseudorandom code which differs at least from another base station which is adjacent thereto for preventing interference with other stations.

In practice, however, a near-far problem can occur, resulting in disturbance to the system. The near-far problem means that a signal to be detected can be interfered with by another signal so as not to be detected according to differences in distances between a base station and origins of signals. The near-far problem means that a desired signal received at a base station can be interference for another base station, depending on the location of the target. Therefore, for train tracking, the system employs Time-Division Multiple Access (TDMA) mixed with CDMA (CDMA-TDMA) as a simultaneous multiple-access scheme since that is one solution to avoid the near-far problem.

Figure 6:
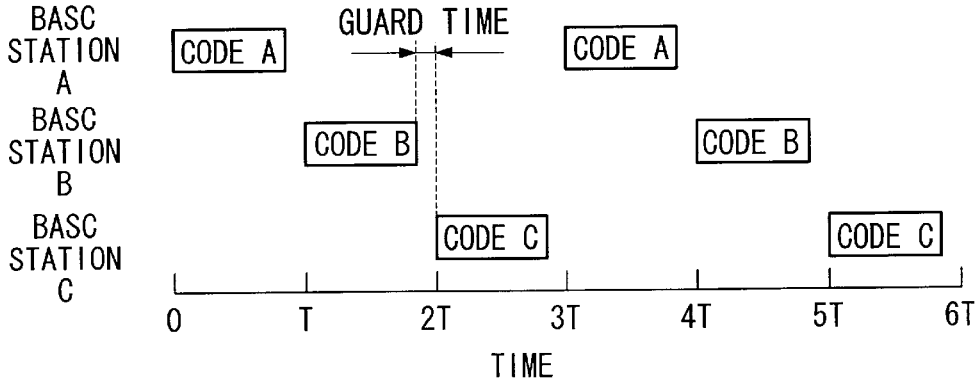
FIG. 6 is an example of a timing chart for CDMA-TDMA employed in the operation in FIG. 5.

FIG. 6 shows one example of a timing chart in TDMA-CDMA employed for the base stations A(12), B(13), C(14). In the example shown in FIG. 6, the base station A detects a train at two periods, time 0 to time T, and time 3T to 4T, by the radar device using CDMA with direct-sequence spread-spectrum where code A is used for channel identification. This detection in the base station A causes interruption, except for in the above periods. Similar to the base station A, the base station B detects a train at two periods, time T to time 2T, and time 4T to time 5T, by the radar device using CDMA with direct-sequence spread-spectrum where code B is used for channel identification. Similar to the base stations A and B, the base station C detects a train at two periods, time 2T to time 3T, and time 5T to 6T, by the radar device using CDMA with direct-sequence spread-spectrum where code C is used for channel identification. Each base station does not continue the detection over the entirety of each period. Each period contains a Guard Time during which no base station detects a train, as shown in FIG. 6. The above detecting in each base station is continuously repeated.

In CDMA-TDMA of the above train detecting system, the minimum sharing time $t_{smin}$ for each base station to detect trains simultaneously consists of a pulse-propagation time for a maximum distance $R_{max}$ and the pulse width $\tau_s$.

$$t_{S\min} = \frac{2R_{\max}}{c} + \tau = \frac{2R_{\max}}{c} + N_S\tau_s \tag{1}$$

In Equation (1), $N_s$ is a pseudorandom length of the sequence, $\tau_s$ is a width of a sub-pulse, and c is the speed of light.

If the system needs M pulses more than 1 pulse for more accurate detection, Equation (1) can be rewritten as $$t'_{S\min} = \frac{2R_{\max}}{c} + M\tau = \frac{2R_{\max}}{c} + MN_S\tau_S \tag{2}$$

Finally, considering a guard time $t_G$ for TDMA, the sharing time $T_G$ for the base stations to detect trains simultaneously is given by $$T = \frac{2R_{\max}}{c} + M\tau + t_G = \frac{2R_{\max}}{c} + MN_S\tau_S + t_G \quad (3)$$

Next, a method for measurement of train position and speed will be explained.

A base station identifies the position and speed of many trains in a zone. The base station performs numbering to each train in order from the train on the front end in order to discriminate among the other trains. The order of the trains is determined from the relative location from the base station and the signs of Doppler shifting. The Doppler shifting for the train approaching has the sign of plus, and the Doppler shifting for the train receding has the sign of minus.

Figure 7:
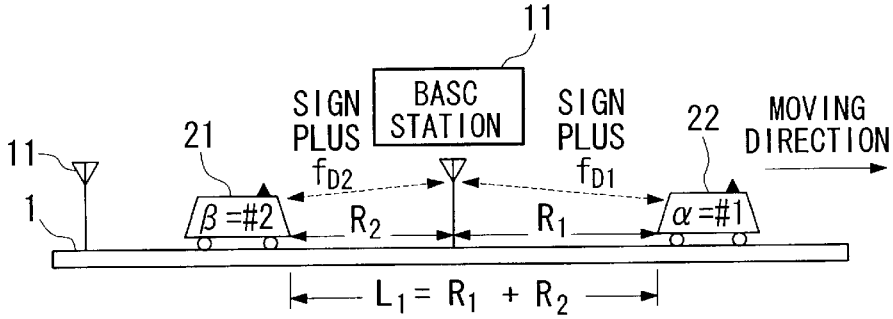
FIG. 7 is an illustration for explaining an example of determination of a position and speed of a train in the embodiment in FIG. 1.

As shown in FIG. 7, considering the two trains α(21) and β(22) in the zone of the base station 11, the train control system measures the distance $R_1$ from the base station 11 to the train α(21) and the distance $R_2$ from the base station 11 to the train β(22), and detects the Doppler shift $f_{D1}$ of the train α(21) and the Doppler shift $f_{D2}$ of the trains β(22). The train control system numbers the train α(21) as #1 and also numbers the train β(22) as #2. Then, the train control system can calculate an interval $L_1$ between the trains #1 and #2 and the speeds thereof The interval $L_1$ can be calculated by adding the distance $R_1$ to the distance $R_2$. A speed command according to the interval $L_1$ is sent to the train #2.

Figure 8:
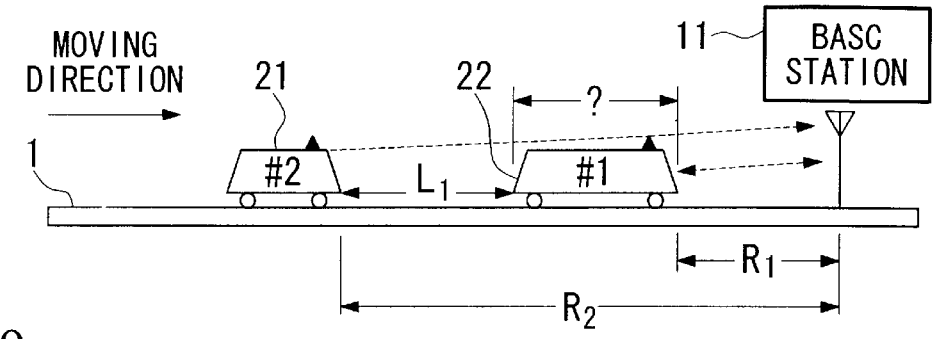
FIG. 8 is an illustration for explaining another example of determinations of a position and speed of a train in the embodiment in FIG. 1.

Next, referring to FIG. 8, another example of two trains in a zone in one side of the base station 11 will be explained. In this example shown in FIG. 8, the trains 21 and 22 exist in the zone of the base station 11. The base station 11 numbers the train 22 as #1 and the train 21 as #2 and can define the position of these trains at their front faces and detects the distance R1 to the train #1 and the distance $R_2$ to the train #2. However the length of the train #1 is unknown; therefore the base station 11 cannot calculate the interval L1 between the trains #1 and #2.

Because the lengths of trains are not necessarily constant, in general, the train control system must also take into account lengths of trains to calculate the interval. To calculate the interval, the train control system needs data from two or more base stations.

Figure 9:
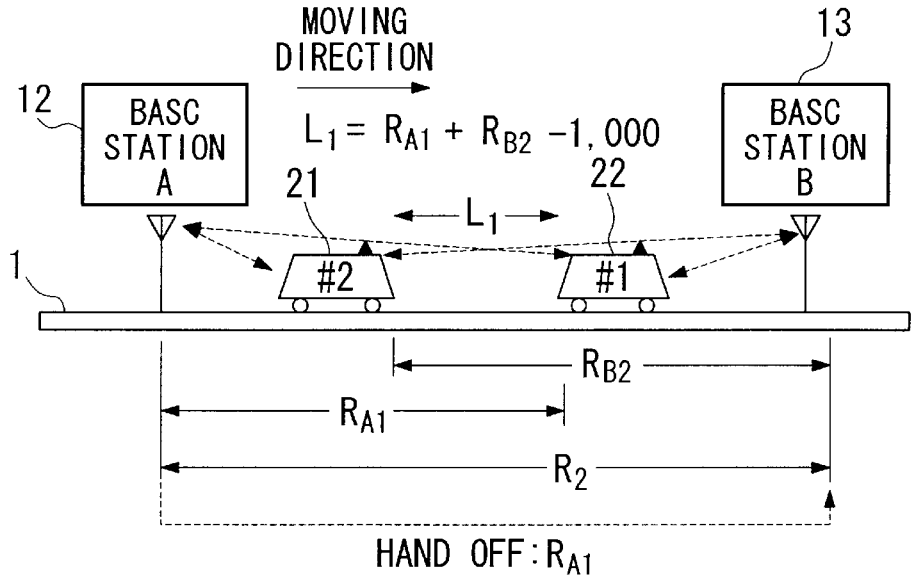
FIG. 9 is an illustration for explaining an example of determinations of positions and the speeds of a plurality of trains in the embodiment in FIG. 1.
Figure 10:
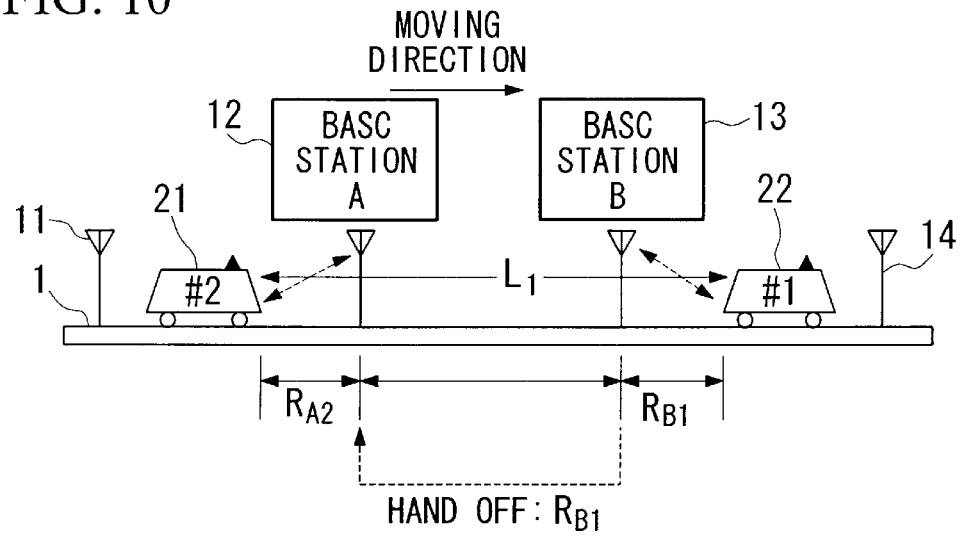
FIG. 10 is an illustration for explaining another example of determinations of positions and the speeds of a plurality of trains in the embodiment in FIG. 1.

One solution for the above example using two base stations is shown in FIGS. 9 and 10. The base station A(12) detects the trains #1(22) and #2(21) from the back side thereof, while the base station B(13) detects the trains #1(22) and #2(21) from the front side of them. The distances $R_{A1}$ between the base station A(21) and train #1(22), $R_{B2}$ between base station B(22) and train #2(21), and an interval (=1,000 m) between the base stations A(12) and B(13) provides the interval $L_1$ between the trains #1(22) and #2(21) according to the equation $L_1=R_{A1}+R_{B2}-1000$. In the above train control system, the interval $L_1$ is calculated at the base station B(13) after the information of the distance $R_{A1}$ is handed off from the base station A(12), so that the base station B(13) can send speed commands to the train #2(21). In general, the speed commands are sent by a base station positioned ahead of trains.

FIG. 10 shows another example of two trains #1(22) and #2(21) which are located from the two base stations A(12) and B(13). In this example, the distance $R_{B1}$ between the base station B(13) and the train #1(22) is determined by the base station B(13) and the distance between the base station A(12) to the train #2(21) is determined by the base stations A(12).

The base station B(13) hands off the distance $R_{B1}$ to the base station A(12), then the base station A(12) combines the distance $R_{B1}$ to the distance $R_{A2}$. The base station A(12) calculates the interval $L_1$ by the equation $L_1=R_{B1}+R_{A2}+1000$ and can send a speed command to the train #2(21) based on the interval thus calculated.

Figure 11:
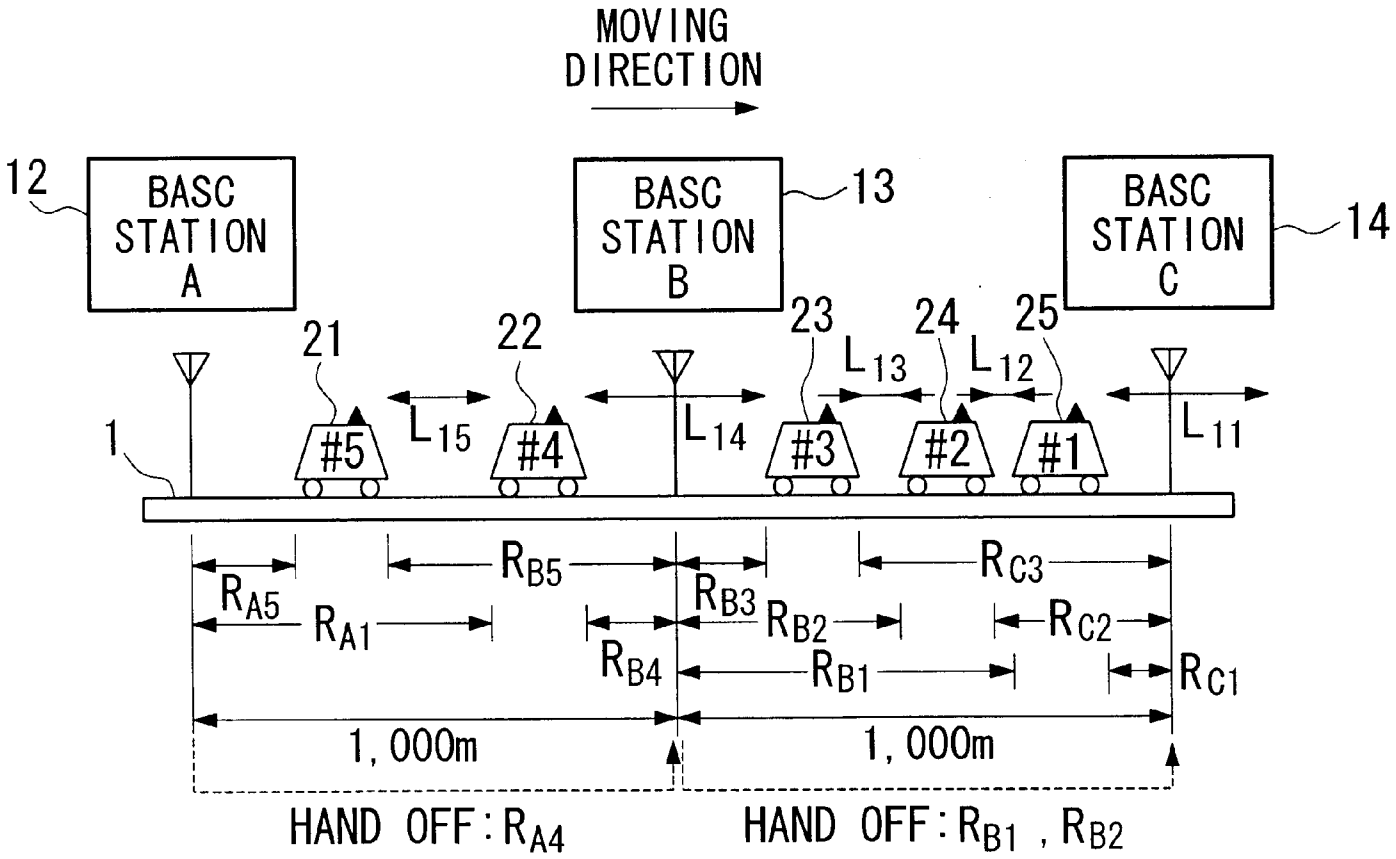
FIG. 11 is an illustration for explaining another example of determinations of positions and the speeds of a plurality of trains in the embodiment in FIG. 1.

Next, we consider another complicated example which has the three base stations A(12), B(13) and C(14) for detecting five trains #5(21), #4(22), #3(23), #4(24) and #5(25) as shown in FIG. 11. The table in FIG. 12 shows what is necessary for the system to compute intervals and a safe speed for each train. In this example, the trains #5(21) and #4(22) are moving while the train #4(22) is leading the train #5(21) in a zone between the base stations A(12) and B(13), and three trains #3(23), #2(24) and #1(25) are moving while the train #1(25) is leading the other trains #2(24) and #3(23) in a zone between the base stations B(13) and C(14).

In FIG. 11, the distances $L_{I5}$~$L_{I1}$ mean the distances between each train #5(21)~#1(25) and one train which leads each of the trains #5(21)~#1(25) and also exists next to each of the trains #5(21)~#1(21). The intervals $R_{A5}$ and $R_{B4}$ mean intervals between the base station A(12) and the trains #5(21) and #4(22) respectively. The intervals $R_{B5}$~$R_{B1}$ mean intervals between the base station B(13) and each of the trains #5(21), #4(22), #3(23), #2(24) and #1(25). The intervals $R_{C3}$~$R_{C1}$ mean intervals between the base station C(14) and each of the trains #3(23), #2(24) and #1(25).

The table in FIG. 12 shows what is necessary for the system to compute intervals and a safe speed for each train. In reference with the column for instance the column for the train #3(23), this column shows that (1) the base station C(14) sends the speed command, (2) the distances of $R_{B2}$ and $R_{C3}$ are needed to calculate the front interval $L_{13}$, (3) the information of $R_{B2}$ is handed off from the base station B(13) to the base station C(14), (4) the base station C(14) detects the speed.

As explained above it is possible to flexibly control the intervals of the trains by the "flexible-block" using radar techniques in place of the conventional "fixed-block" and also to maintain cables using less number of cables. Because the train control system controls the train without using any relay, it is also possible to reduce the cost for maintenance. Furthermore, it is possible to encipher a signal and also to reduce interference and noise by using a expanded-spectrum technique for determining a position and speed of a train by a radar. It is also possible to detect plurality of trains by radar beams with number of carrier frequencies less than number of base stations by using CDMA and TDMA technique. A system where some techniques, for instance CDMA, are omitted is also possible in the present invention.

To obtain further improved performance it is possible to provide a wall along a track in order to increase an efficiency of propagation.

The train control system of the present invention can be combined with a conventional train control system using "fixed-blocks".

It is possible to separate the actions of the radar devices into one device for detecting a position and a direction of a target and another device for detecting a speed of the target. It is also possible to calculate data by the central base station in place of having each base station do so in order to control the trains.

What is claimed is:

1. A train control system for controlling trains of at least one vehicle that travel along a train rail comprising:

a plurality of base stations at predetermined intervals along the train rail, each base station comprising:

a radar for detecting data of distance between the base station and trains moving on the train rail within a predetermined distance of the base station;

a traveling command calculator for calculating a traveling command based on the data of distance detected by said radar and the radar of another base station, said traveling command calculator comprising a signal transmitter-receiver which transmits and receives distance data detected between each base station and one or more trains;

a train interval calculator which calculates distances between the trains from the distance data between a base station and the one or more trains as detected by the radar of the base station, or by the distance data detected between another base station and the one or more trains received by the signal transmitter-receiver of the base station; and a speed command calculator which calculates from the distances calculated by said train internal calculator a speed command to be transmitted as a traveling command for one or more trains to which the speed command must be sent; and a traveling command providing means for providing to the trains the traveling command calculated by said traveling command calculator.

2. A train control system according to claim 1, wherein said radar of a base station comprises an antenna having mutually opposite bi-directional directivity along the train rail.

3. A train control system according to claim 1, wherein said radar of a base station transmits a radar beam using Code-Division Multiple Access with direct-sequence spread-spectrum, and an identifying code that differs said radar at least from another radar of a base station which is adjacent thereto.

4. A train control system according to claim 1, wherein said radar of a base station transmits a radar beam using Code-Division Multiple Access with the direct-sequence spread-spectrum, and an identifying code for the each radar is generated pseudo-randomly.

5. A train control system according to claim 1, wherein a period during which said radar of a base station transmits, the radar beam is adjusted on a time-division basis at least with respect to the radar of an adjacent base station.

6. A train control system according to claim 4, wherein a period during which said radar of a base station transmits, the radar beam is adjusted on a time-division basis at least with respect to the radar of an adjacent base station.

7. A train control system according to claim 3, wherein said radars of all of the base stations each transmits a radar beam having the same carrier frequency.

8. A train control system according to claim 3, wherein said radars of all of the base stations each transmits a radar beam having the same carrier frequency.

9. A train control system according to claim 1, wherein said train interval calculator calculates the distance between the trains by the distance data between a base station and one or more trans, by the distance data between another base station and said one or more trains received by the signal transmitter-receiver of the base station, and by distance data between one base station and another base station.

10. A train control system according to claim 1, wherein a said traveling command providing means is provided in each of the plurality of base stations and comprises a traveling command transmitter which transmits the traveling command calculated by the traveling command calculator of the respective base stations to the one or more trains assigned thereto, and a train identifying data receiver which receives a signal containing an identifying data of each train sent by each train.

11. A train control system according to claim 1 wherein said radar of each base station detects distance data of one or more trains on the rail within a predetermined distance zone.

12. A train control system according to claim 1 wherein said radar of each base station also detects speed data of the one or more train on the rail for which distance data was detected.

13. A method for controlling trains of one or more vehicles by a plurality of base stations spaced at predetermined intervals along a train rail along which the trains travel comprising the steps of:

detecting data of distance between each base station and one or more trains moving on the train rail by a radar at each base station;

transmitting the distance data between each base station and the one or more trains detected by the radar at the base station from one base station to another base station;

calculating the distances between the trains by the distance data received from another base station and the distance data detected by the one base station;

calculating in response to the calculated distances a speed command to be transmitted as a traveling command for one or more trains to which the speed command must be sent; and calculating a traveling command based on the distance data between one or more trains and each base station detected by the radar of the respective base station.

14. A method for controlling trains according to claim 13, wherein said radar of a base station comprises an antenna having mutually opposite bi-directional directivity along a track.

15. A method for controlling trains according to claim 13, wherein said radar of a base station transmits a radar beam using Code-Division Multiple Access with a direct-sequence spread-spectrum, and an identifying code that each radar differs at least from said radar of the base station which is adjacent thereto.

16. A method for controlling trains according to claim 13, wherein said radar of a base station transmits a radar beam using Code-Division Multiple Access with a direct-sequence spread-spectrum, and an identifying code for each radar is generated pseudo-randomly.

17. A method for controlling trains according to claim 13, wherein a period during which said radar of a base station transmits the radar beam adjusted on a time-division basis at least with respect to the radar of an adjacent base station.

18. A method for controlling trains according to claim 13, wherein said radars of all of said base stations transmit a radar beam having the same carrier frequency.

19. A method for controlling trains according to claim 13, further comprising steps of:

calculating the distance between the trains by the distance data detected between a base station and one or more trains, by the distance data detected between another base station and one or more trains and by distance data between one base station and another base station.

20. A method for controlling train according to claim 13 wherein said detecting step further comprises said radar of each base station detecting distance data of one or more trains on the rail within a predetermined distance zone.

21. A method for controlling train according to claim 13 wherein said detecting step further comprises said radar of each base station also detecting speed data of the one or more trains on the rail for which distance data was detected.

* * * * *